United States Patent [19]

Molenaar et al.

[11] Patent Number: 5,020,992

[45] Date of Patent: Jun. 4, 1991

[54] SHAFT FURNACE

[75] Inventors: Ronald N. Molenaar, Heemskerk; Joseph A. M. Van der Hoeff, Limmen, both of Netherlands

[73] Assignee: Hoogovens Groep B.V., IJmuiden, Netherlands

[21] Appl. No.: 583,844

[22] Filed: Sep. 13, 1990

[30] Foreign Application Priority Data

Sep. 25, 1989 [NL] Netherlands ..... NL 8902381

[51] Int. Cl.[5] ..... F27D 1/08; F27B 14/08

[52] U.S. Cl. ..... 432/248; 432/252; 432/99

[58] Field of Search ..... 432/3, 75, 248, 252, 432/99

[56] References Cited

U.S. PATENT DOCUMENTS

| | | | |
|---|---|---|---|
| 1,827,194 | 10/1931 | Grothe | 432/252 |
| 3,256,665 | 6/1966 | Salmi | 432/252 |
| 3,329,420 | 7/1967 | Finn | 432/252 |
| 3,560,164 | 2/1971 | Venable, Jr. | 432/252 |
| 3,752,638 | 8/1973 | Van Laar et al. | 432/252 |
| 4,155,703 | 5/1979 | Mantey et al. | 432/248 |
| 4,565,525 | 1/1986 | Van Laar et al. | 432/248 |
| 4,852,859 | 8/1989 | Van Laar et al. | 432/95 |
| 4,960,379 | 10/1990 | Schneider | 432/3 |

FOREIGN PATENT DOCUMENTS 8301862 12/1984 Netherlands .

OTHER PUBLICATIONS

Patent Abstracts of Japan, vol. 1, No. 48, Y. Nakamura, 5/11/77.

Patent Abstracts of Japan, vol. 12, No. 47 (C-475)(2894), T. Fukutake, 2/12/88.

*Primary Examiner*—Henry C. Yuen

*Attorney, Agent, or Firm*—Stevens, Davis, Miller & Mosher

[57] ABSTRACT

A shaft furnace with a steel outer shell and a refractory lining inside the shell, has a sealed tap hole structure comprising a steel sleeve fitted to the outer shell, a permanent lining inside the sleeve and a refractory sealing material within said permanent lining. To improve the gas-tightness of the tap hole structure, a metal closure plate having an opening at which the tap hole is to be formed, is located within the steel sleeve and has its periphery coupled gas-tightly to the sleeve. A metal closure sleeve is coupled gas-tightly to said closure plate around said opening thereof and extends outwardly from said closure plate. Means e.g. conductive bricks are provided for removing heat from the closure plate and the closure sleeve.

11 Claims, 5 Drawing Sheets

SECTION A - A

SECTION B - B

SECTION A - A

SHAFT FURNACE

BACKGROUND OF THE INVENTION

1. Field of the Invention

The invention relates to a shaft furnace and more particularly to the tap hole structure of a shaft furnace.

2. Description of the Prior Art

Dutch patent application no. 8301862 describes a metallurgical shaft furnace, e.g. a blast furnace, comprising a steel outer shell and a refractory lining which is fitted inside and against the steel outer shell. The furnace has at least a tap hole structure which is composed of a steel sleeve, also called a cooling box, fitted on the outer shell, within which sleeve a permanent lining is fitted. Within and against the permanent lining is a refractory sealing material at the location where the tap hole is to be formed. The permanent lining and the sealing material lie directly against the refractory lining of the shell. The sealing material may be refractory bricks or a refractory compressed compound, for sealing off the tap hole.

A problem with this known shaft furnace is that it is liable to gas leaks, specifically carbon monoxide gas coming out of the furnace at the tap hole. In order to avoid this gas leakage, in a known structure illustrated by FIGS. 1 to 3 of the accompanying drawings and described in detail below, the refractory lining of the furnace in the surroundings of the tap hole is provided with a double cage structure with copper sheets. However, the sealing which can be achieved in this way is not such that gas leakage is fully prevented. In some cases the gas leakage may still be so great that gas discharging from the closed tap hole ignites directly after escaping from the furnace. This is an unsafe and undesirable situation. But even if the discharging gas does not burn, the situation may still be unsafe given that the discharging gas is rich in carbon monoxide which makes work in the surroundings of the tap hole impossible to carry out because of the danger of poisoning, or possible only when carried out under inconvenient conditions (with gas masks). Furthermore there is another inconvenience. The escaping CO gas affects the binder of the rammed compound so that the service life of the tap hole sealing is limited.

Japanese liad-open patent application no. JP-A-52-7308 (1977) discloses a method of preventing gas leakage at the tap hole by applying a temporary metal box at the exterior of the refractory lining and injecting refractory material to seal the lining.

SUMMARY OF THE INVENTION

The object of the invention is to avoid or reduce the problem of gas leakage described above.

In accordance with the invention the tap hole structure is provided with a metal closure plate which is fitted against the refractory lining of the furnace. The closure plate is provided with an opening for the passage of hot metal during tapping, and is coupled gas-tightly to the steel sleeve of the tap hole structure. Means are provided for dissipating heat from the closure plate.

The provision of this closure plate, transversely across the steel sleeve, has been found to reduce leaks very considerably. In addition the furnace in accordance with the invention has the advantage that the double cage structure of the known structure described above becomes superfluous. The structure of the tap hole is consequently much simplified and less costly. The closure plate may be permanently present, i.e. it is not removed for each tapping.

Preferably the tap hole structure of the invention is also provided with a metal closure sleeve which is coupled gas-tightly to the closer plate, around the opening in the closer plate, the permanent lining and sealing compound material of the tap hole being inside the closure sleeve. The means for dissipating heat from the closure plate are also effective for heat discharge from the closure sleeve. This has the advantage that the tap hole structure is more sound and robust so that less maintenance is required. Also the risk of gas leakage is further reduced because the opening for the passage of hot metal is better defined and as a result the surface area over which gas leakage can occur is still further reduced.

In the shaft furnace in accordance with the invention it is essential that means are provided for dissipating heat from the closure plate and where applicable the closure sleeve. This is to prevent them from buckling, which might destroy their gas sealing action. Furthermore, this cooling is desirable in order to counter as much as possible expansion of the refractory material in the vicinity, thereby improving its service life.

It is conceivable to apply a water film as coolant continually on the outside of the closure plate and the closure sleeve. However, it is preferable that the means of dissipating heat are refractory bricks with a coefficient of heat conductivity higher than approx. 25 kcal/m° C.h, which bricks are fitted on the outside of the closure plate and closure sleeve and are in direct contact with the outer steel sleeve of the tap hole strcture. Preferably graphite bricks are used.

Gas sealing of the shaft furnace in accordance with the invention is further improved if on the side of the closure plate facing the refractory lining of the furnace, there is at least one labyrinth gland ring, which at least in part surrounds the opening for the passage of hot metal. By using one or more labyrinth glands, any leaking gas has to travel a greater distance. Resistance to gas leakage is thereby increased. A simple and effective way of arranging such a labyrinth gland ring is obtained when the closure sleeve is elongated so that a labyrinth gland ring is formed at the inside face of the closure plate, by a part of the closure sleeve. This gland ring is then a labyrinth gland with the smallest possible diameter.

It is also desirable for the closure plate to be provided with at least one aperture for pressing in refractory material on the side of the closure plate side facing the refractory lining of the furnace. This permits optimum thermal coupling of the closure plate to the refractory lining.

The metal closure plate may be made for example of steel. This material places high demands on the quality of the cooling in order to equalize as much as possible temperature differences over the closure plate so that expansion differences, of the surrounding refractory material too, may be prevented.

However, the best results are achieved by using an essentially copper as the material for the closure plate. In this case, the closure plate is provided with an encircling steel ring which is attached gas-tightly to the closure plate. This has the advantage that the difficult joint between steel and copper may be made elsewhere, before the closure plate is placed in the shaft furnace, and that installation in the furnace may be carried out by means of a simple steel/steel weld joint.

BRIEF INTRODUCTION OF THE DRAWINGS

The invention will be illustrated by description of a non-limitative embodiment, with reference to the accompanying drawings.

DESCRIPTION OF THE PREFERRED EMBODIMENT

In all the figures, corresponding parts are indicated by the same reference numbers.

Figure 1:
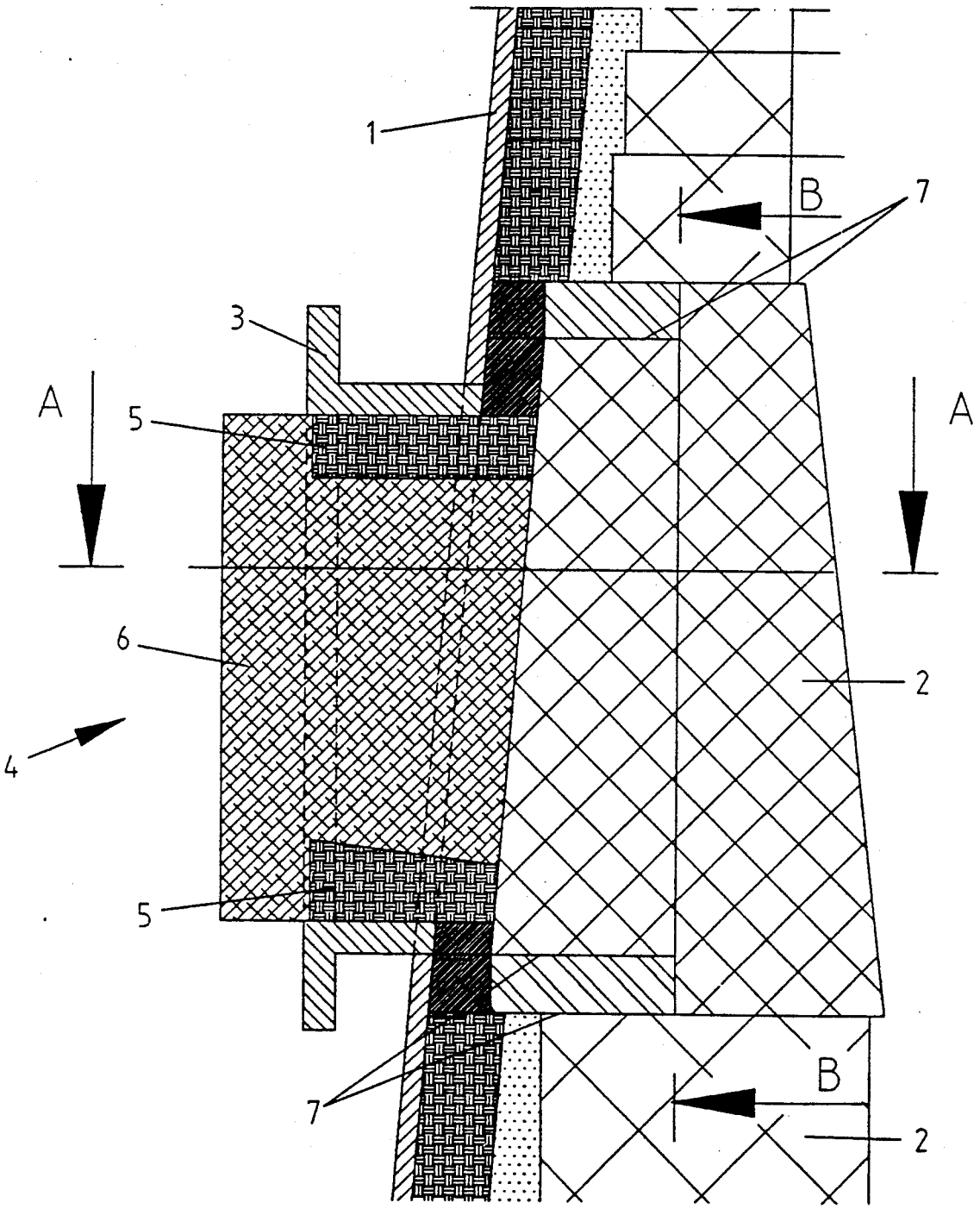
FIG. 1 is a detail of a cross-section of the known shaft furnace already mentioned.
Figure 2:
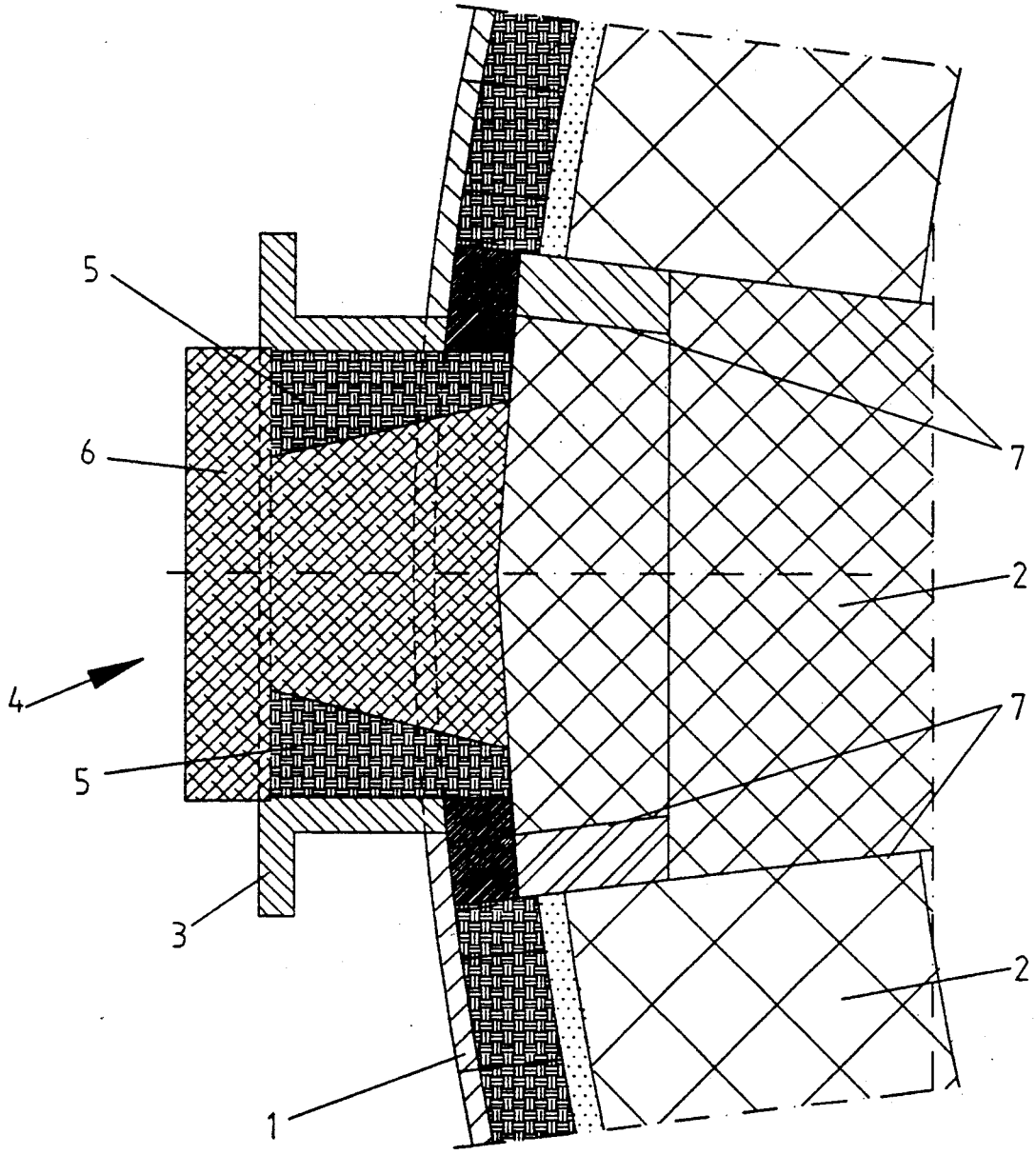
FIG. 2 is a detail of a cross-section of the shaft furnace of FIG. 1 in top view on the line A—A in FIG. 1.
Figure 3:
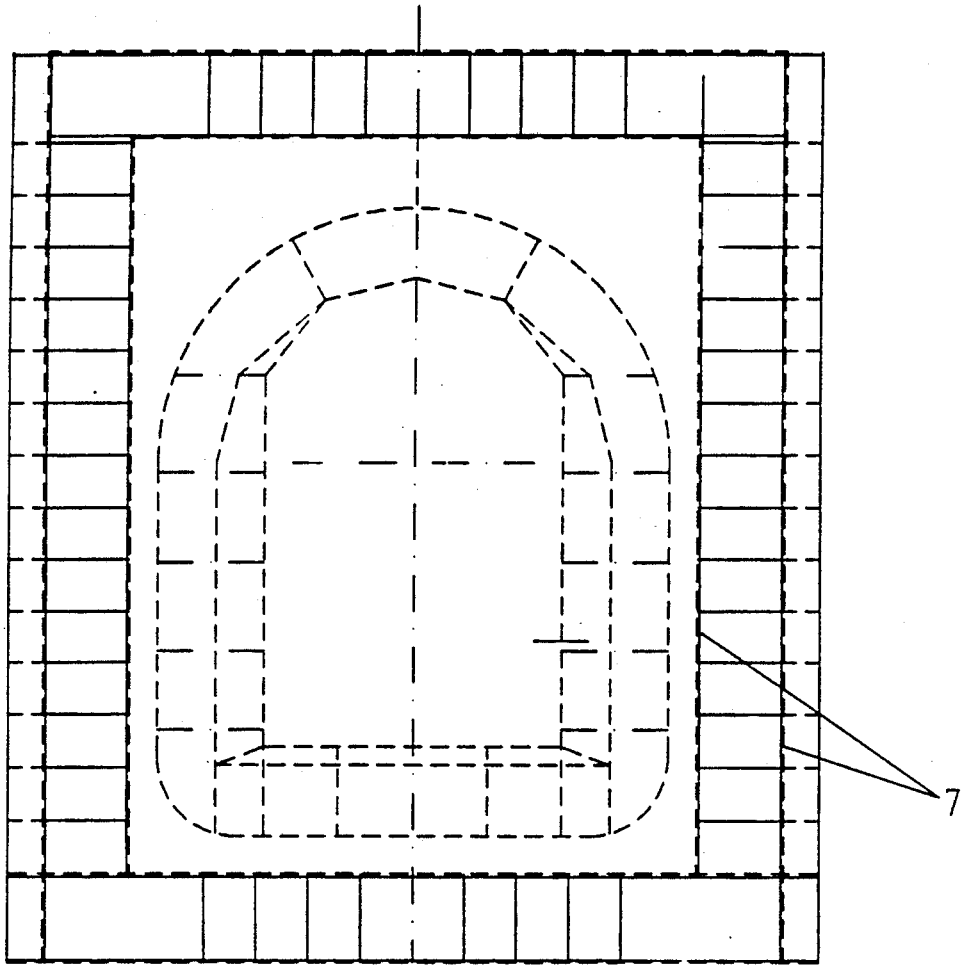
FIG. 3 is a detail of a cross-section of the shaft furnace of FIG. 1 in front view on the line B—B FIG. 1.

Referring to FIGS. 1 to 3, inside the steel outer shell 1 is the conventional refractory lining 2 of the shaft furnace. An outwardly projecting steel tap hole sleeve or cooling box 3 is fitted on the steel outer shell 1 as a component of the tap hole structure. The sleeve 3 ends at a flange. Inside and against the sleeve 3 there is permanent lining 5 and a refractory rammed compound 6, the latter sealing off the tap hole (see FIGS. 1, 2 and 3). The refractory rammed compound 6 is partly removed, when a tap hole is made, in order to tap the furnace. The permanent lining 5 and the rammed compound 6 are in direct contact with the refractory lining 2 in the shaft furnace. Furthermore, a double cage structure 7 of copper sheet and of larger dimensions than the sleeve 3 is provided in the refractory lining 2 with the aim of preventing gas leakage through the structure of the tap hole 4.

Figure 4:
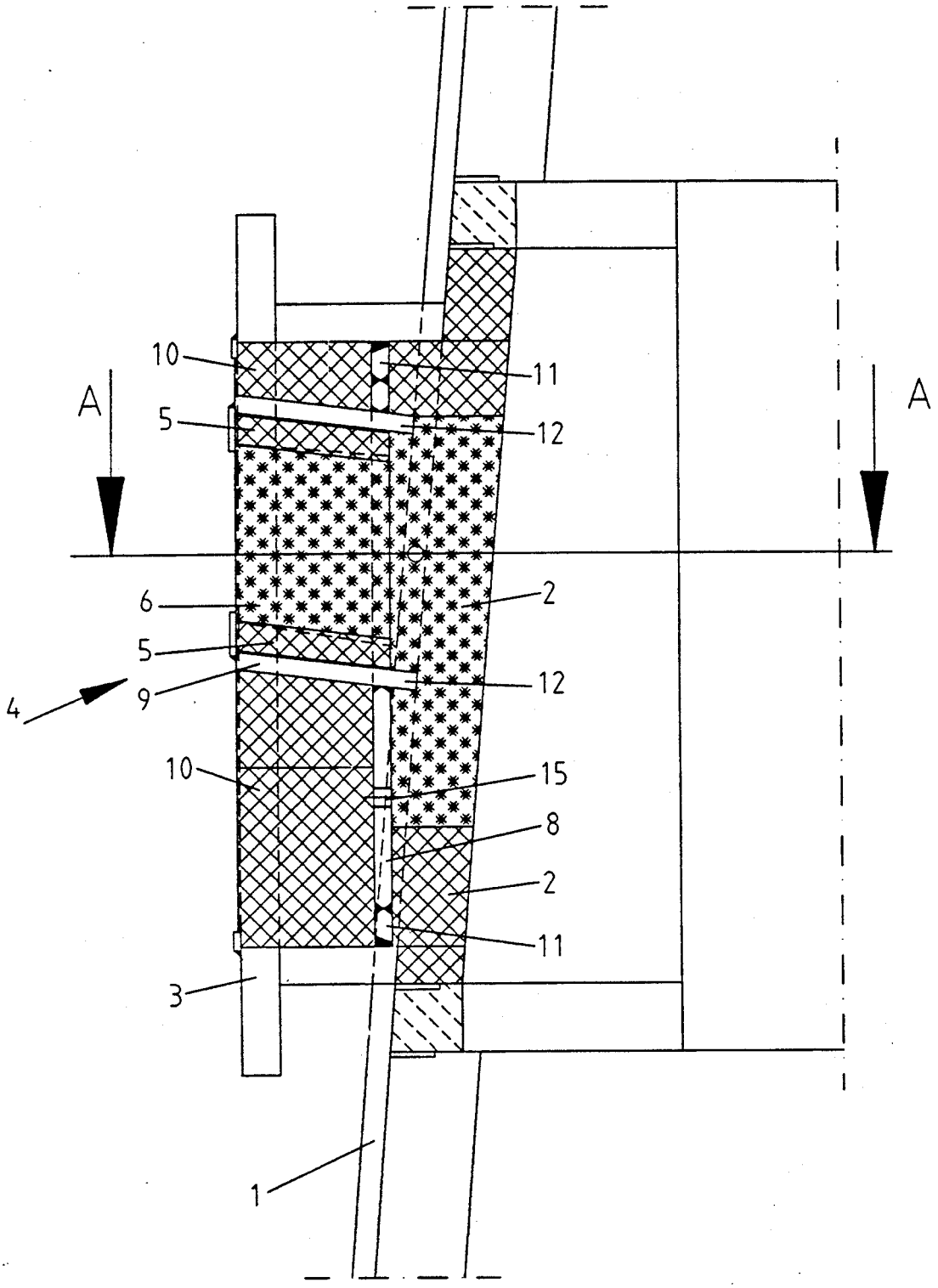
FIG. 4 is a detail of a cross-section of a shaft furnace embodying the present invention, in side view; and, FIG. 5 is a detail of a cross-section of the shaft furnace of FIG. 4 on the line A—A in FIG. 4.
Figure 5:
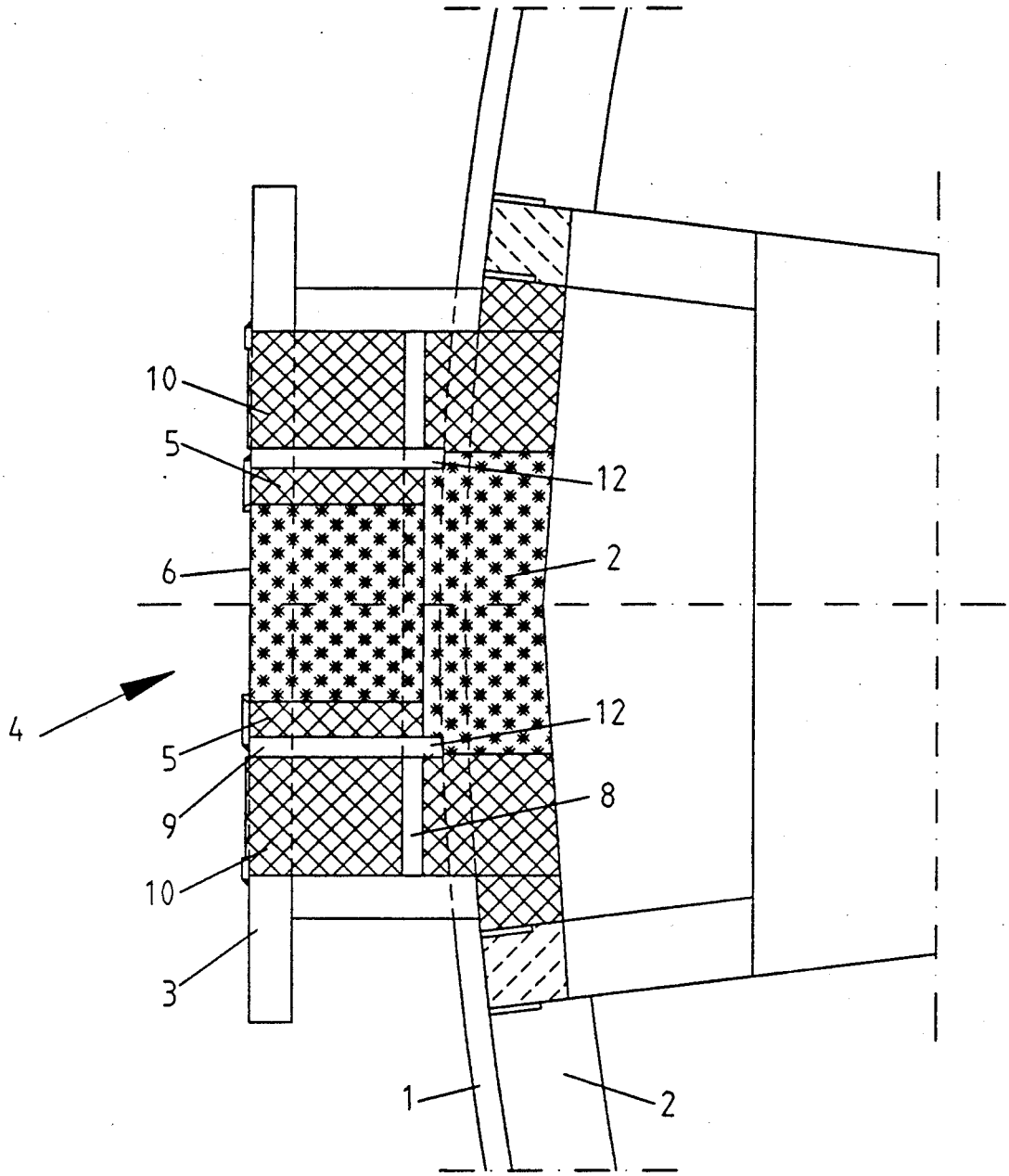

In accordance with the present invention, the tap hole 4 may now be made without this double cage structure (see FIGS. 4 and 5). Gas sealing is obtained by using a copper closure plate 8 onto which a copper closure sleeve 9 is, in this embodiment, fitted. The closure plate 8 extends transversely to the tap hole direction and its outer periphery is gas-tightly connected to the steel sleeve 3 as described below. The permanent lining 5 and the refractory rammed compound 6 are inside the closure sleeve 9 and they again lie directly against the refractory lining 2. Instead of the refractory rammed compound 6, refractory bricks may also be used for sealing the tap hole within the scope of the invention.

The closure plate 8 lies directly against the refractory lining 2 and is provided with an opening for the passage of hot metal out of the shaft furnace during tapping, into which opening the closure sleeve 9 is coupled by welding. Closure sleeve 9 extends around the tap hole location away from the plate 8 and may, as shown, be made to be somewhat elongated inwardly so that the portion 12 extending past the closure plate 8 forms a labyrinth gland ring of the smallest possible diameter. Further, the closure plate 8 may also be provided with further labyrinth gland rings (not shown in the drawings) of a larger diameter, in order to hinder the gas escape more.

Between and beside the labryinth gland rings used, there are one or more forcing apertures or sockets for pressing in refractory material on the closure plate 8 side facing the refractory lining 2. In this way optimum thermal coupling of the closure plate 8 to the refractory lining 2 may be achieved. In FIG. 4, just one such forcing socket 15 is illustrated. After pressing in the refractory material, such forcing sockets are then closed off for example with a flat socket nut.

Closure sleeve 9 and closure plate 8 are cooled by refractory bricks 10 which are fitted directly onto the outside of the closure sleeve 9 and the closure plate 8. These bricks have a high coefficient of heat conductivity (higher than 25 kcal/m° C.h) and form a thermal bridge to the steel sleeve 3. The refractory bricks 10 are of graphite and give optimum temperature equalization for the closure sleeve 9 and closure plate 8. The closure sleeve 9 and closure plate 8 in this embodiment are made of copper. At its periphery, the closure plate 8 is welded gas-tightly to a steel ring 11 which itself is gas-tightly welded to the steel sleeve 3.

This construction is simple and permits easy sealing of the tap hole after tapping. The seal is good, and is well maintained until the next tapping.

What is claimed is:

1. A shaft furnace having
(a) a steel outer shell
(b) a refractory lining inside and against said outer shell
(c) at least one sealed tap hole structure comprising
(i) a steel sleeve fitted to said outer shell and projecting outwardly therefrom
(ii) a permanent lining inside said sleeve
(iii) a refractory sealing material within said permanent lining, which sealing material is to be at least partly removed when a tap hole is formed
(iv) a metal closure plate having an opening at which said tap hole is to be formed, said plate being located within said sleeve and having a periphery coupled gas-tightly to said sleeve, and
(v) means for removing heat from said closure plate,
(vi) said permanent lining, said refractory sealing material and said closure plate each being located against said refractory lining of said outer shell.

2. A shaft furnace according to claim 1 wherein said tap hole structure further includes a metal closure sleeve coupled gas-tightly to said closure plate around said opening thereof and at least extending outwardly from said closure plate in the direction away from said outer shell, said permanent lining and said refractory sealing material being within said closure sleeve and said heat-removing means being effective to remove heat also from said closure sleeve.

3. A shaft furnace according to claim 1 wherein said heat-removing means comprises refractory bricks having a coefficient of thermal expansion of at least 25 kcal/m.° C.h, said refractory bricks contacting said closure plate and said steel sleeve.

4. A shaft furnace according to claim 3 wherein said refractory bricks are graphite bricks.

5. A shaft furnace according to claim 1 wherein at least one labyrinth seal ring is provided around said opening of said closure plate at the side thereof facing said refractory lining.

6. A shaft furnace according to claim 2 wherein said closure sleeve has a portion projecting inwardly from said closure plate in the direction towards said refractory lining of said outer shell, so as to provide a labyrinth seal ring around said opening of said closure plate.

7. A shaft furnace according to claim 1 wherein said closure plate is provided with at least one aperture, spaced from said opening thereof, for use in pressing in refractory material on the side of said closure plate facing said refractory lining.

8. A shaft furnace according to claim 1 wherein said closure plate is essentially made of copper.

9. A shaft furnace according to claim 8 having a steel ring having an inner periphery gas-tightly bonded to said periphery of said closure plate and an outer periphery gas-tightly bonded to said steel sleeve.

10. A shaft furnace having (a) a steel outer shell (b) a refractory lining inside and against said outer shell (c) at least one sealed tap hole structure comprising (i) a steel sleeve fitted to said outer shell and projecting outwardly therefrom (ii) a permanent lining inside said sleeve (iii) a refractory sealing material within said permanent lining, which sealing material is to be at least partly removed when a tap hole is formed (iv) a metal closure plate having an opening at which said tap hole is to be formed, said plate being located within said sleeve and having a periphery coupled gas-tightly to said sleeve, (v) a metal closure sleeve coupled gas-tightly to said closure plate around said opening thereof and at least extending outwardly from said closure plate in the direction away from said outer shell, said permanent lining and said refractory sealing material being at least partly located within said closure sleeve, and (vi) means for removing heat from said closure plate and said closure sleeve.

11. A shaft furnace according to claim 10 wherein said heat-removing means comprises thermally conductive refractory bricks contacting said steel sleeve, said closure plate and said closure sleeve.

* * * * *